US006067975A

United States Patent [19]

Ginn

[11] Patent Number: 6,067,975

[45] Date of Patent: May 30, 2000

[54] PULSATING TOY GUN HAVING RECIPROCATING BARRELS

[75] Inventor: Wayne M. Ginn, Independence, Ky.

[73] Assignee: Hasbro, Inc., Pawtucket, R.I.

[21] Appl. No.: 09/073,225

[22] Filed: May 5, 1998

[51] Int. Cl.[7] ..... F41B 11/00

[52] U.S. Cl. ..... 124/59; 124/65; 124/66; 124/79

[58] Field of Search ..... 124/59, 63, 65, 124/66, 67, 79

[56] References Cited

U.S. PATENT DOCUMENTS

| | | | |
|---|---|---|---|
| 2,149,749 | 5/1939 | Savage | 273/106 |
| 3,262,440 | 7/1966 | Kuhn | 124/15 |
| 3,370,581 | 2/1968 | Hills et al. | 124/15 |
| 3,765,396 | 10/1973 | Klenholz et al. | 124/59 |
| 4,732,136 | 3/1988 | Ferri | 124/67 |
| 5,113,842 | 5/1992 | Moormann | 124/65 |
| 5,242,323 | 9/1993 | Rappaport | 124/66 |
| 5,267,549 | 12/1993 | Webber | 124/65 |
| 5,343,850 | 9/1994 | Steer | 124/64 |
| 5,377,655 | 1/1995 | Arad | 124/65 |
| 5,377,656 | 1/1995 | Lewinski et al. | 124/65 |
| 5,531,210 | 7/1996 | Meiser et al. | 124/66 |
| 5,553,598 | 9/1996 | Johnson et al. | 124/63 |
| 5,564,964 | 10/1996 | Chin-Chien | 446/406 |
| 5,605,140 | 2/1997 | Griffin | 124/59 |
| 5,653,215 | 8/1997 | Chung et al. | 124/66 |
| 5,660,159 | 8/1997 | Clayton | 124/66 |
| 5,711,285 | 1/1998 | Stewart et al. | 124/67 |

FOREIGN PATENT DOCUMENTS 2 250 574 10/1992 United Kingdom .

*Primary Examiner*—J. Woodrow Eldred
*Attorney, Agent, or Firm*—Marshall, O'Toole, Gerstein, Murray & Borun

[57] ABSTRACT

A toy gun having a pair of reciprocating barrels for an alternating sequence of foam projectiles. The toy gun includes a body and a pair of barrels slidably mounted to the body and being adapted for movement along a longitudinal path between a rearward position and a forward position. Each of the barrels includes a longitudinal rack and an internal pneumatic plunger assembly. The forward portion of each barrel defines a launch chamber adapted to receive one or more foam projectiles. The gun includes a moveable handle engaging one of the barrels, and an actuating pinion mounted to the body engages each of the barrel racks, so that the actuating pinion moves the barrels in opposite directions between their respective forward and rearward positions in response to movement of the handle, such that each plunger assembly pressurizes its adjacent launch chamber in response to rearward movement of the barrel. Accordingly, a projectile is launched from the launch chamber of each barrel in alternating fashion as each barrel moves toward its respective rearward position.

25 Claims, 7 Drawing Sheets

PULSATING TOY GUN HAVING RECIPROCATING BARRELS

FIELD OF THE INVENTION

The present invention relates generally to toy pneumatic guns for launching foam projectiles. More specifically, the present invention relates to a toy gun having a pair of reciprocating barrels, each of which launches a foam projectile in alternating fashion in response to fore and aft movement of the barrel.

BACKGROUND AND SUMMARY OF THE INVENTION

Toy air guns that launch a foam projectile using a blast of compressed air are generally well known in the art. Because such guns launch an actual projectile, they satisfy a child's desire for realism. More importantly, because the projectiles are soft, the guns satisfy a parent's desire for safety. However, the attention span of a typical child is relatively limited, and thus the most popular toy guns are those which incorporate a variety of complex, realistic, and futuristic features. Accordingly, there is a continuing need for increasingly complex, realistic and futuristic toy guns that will enhance the play value of the toy, stimulating a child's imagination.

The toy gun according to the present invention incorporates the safety of a pneumatic soft foam projectile launcher with a number of complex and futuristic features. The toy gun according to the present invention includes a pair of reciprocating barrels, each of which includes a pneumatic launcher assembly which is adapted to launch a projectile in response to the reciprocating movement of the barrel. Each barrel is equipped to hold a plurality of projectiles, so that the gun is able to fire a barrage of projectiles in rapid succession from each barrel alternating fashion. The resulting fusillade of projectiles emanating from the pulsating, reciprocating barrels elicits images of highly advanced and futuristic space weaponry, thus greatly enhancing the play value of the present toy.

According to one aspect of the invention, a toy gun for launching foam projectiles includes a body and a pair of barrels slidably mounted to the body and being adapted for movement along a longitudinal path between a rearward position and a forward position. Each of the barrels includes a longitudinal rack and an internal plunger assembly. The forward portion of each barrel defines a launch chamber adapted to receive a foam projectile. The gun includes a moveable handle attached to one of the barrels, and an actuating pinion mounted to the body engages each of the barrel racks, so that the actuating pinion moves the barrels in opposite directions between their respective forward and rearward positions in response to movement of the handle. Each plunger assembly pressurizes its adjacent launch chamber in response to rearward movement of the barrel. Accordingly, a projectile is launched from the launch chamber of each barrel in alternating fashion as each barrel moves toward its respective rearward position.

Each barrel includes an interior surface, and the plunger assembly includes a stationary seal which registers with the barrel interior surface to pressurize the launch chamber as the barrel is moved rearwardly. The launch chamber of each barrel includes a forward end having an inwardly extending annular lip which forms a seat sized to receive a foam projectile. The annular lip is deformable, so that a projectile disposed against the seat is released in response to increasing pressure in the launch chamber. Moreover, each of the barrels is adapted to receive a plurality of foam projectiles, thereby launching the foam projectiles in repeating sequence from alternating barrels in response to repeated forward and rearward movement of the handle. An internal spring biases the projectiles toward the launch chamber seat.

The handle is moveable along a longitudinal path, which is generally parallel to the path traveled by each of the barrels. The body includes a longitudinal guide passage, and the moveable handle extends through the guide passage to attach to a rearward portion of one of the barrels. Accordingly, movement of the handle imparts movement to the barrels. Preferably, the barrels are spaced apart and generally parallel to each other, and the actuating pinion is preferably mounted between the barrels and pivots about a vertical axis.

According to another aspect of the invention, a toy gun for launching foam projectiles includes a body and a pair of barrels slidably mounted to the body in spaced apart parallel arrangement. Each of the barrels is adapted for movement along a longitudinal path between a rearward position and a forward position, and includes a pneumatic plunger or launcher assembly. A forward portion of each barrel defines a launch chamber adapted to receive a plurality of foam projectiles. A moveable handle operatively engages one of the barrels, and an actuator is mounted to the body and engages each of the barrels. The actuator thus imparts opposing linear movement to the barrels between their respective forward and rearward positions in response to fore and aft movement of the handle. Accordingly, the launch chamber in each barrel is pressurized in response to rearward movement of the barrel, thereby causing a sequence of projectiles to be launchings from alternating barrels as the barrels move toward their respective rearward positions.

According to yet another aspect of the invention, a toy gun for launching foam projectiles comprises a body, a pair of spaced apart barrels slidably mounted to the body, and a moveable handle attached to one of the barrels and being moveable along a path. A stationary handle attached to the body may also be included. Each of the barrels is moveable along a path between a rearward position and a forward position, and each barrel includes a pneumatic launching mechanism and a forward portion that defines a launch chamber adapted to receive a plurality of foam projectiles. Each launch chamber being pressurized in response to rearward movement of its adjacent barrel. Actuation means, responsive to movement of the handle, are provided for moving the barrels in opposite directions between their respective forward and rearward positions. As the handle is moved back and forth, the barrels move back and forth in opposite directions. Thus, a sequence of projectiles is launched from alternating barrels as the handle is repeatedly moved along its generally linear path.

The aforementioned features and advantages, in addition to other features and advantages, will become readily apparent to those skilled in the art upon a reading of the following detailed description.

DETAILED DESCRIPTION OF THE PREFERRED EMBODIMENT

Figure 1:
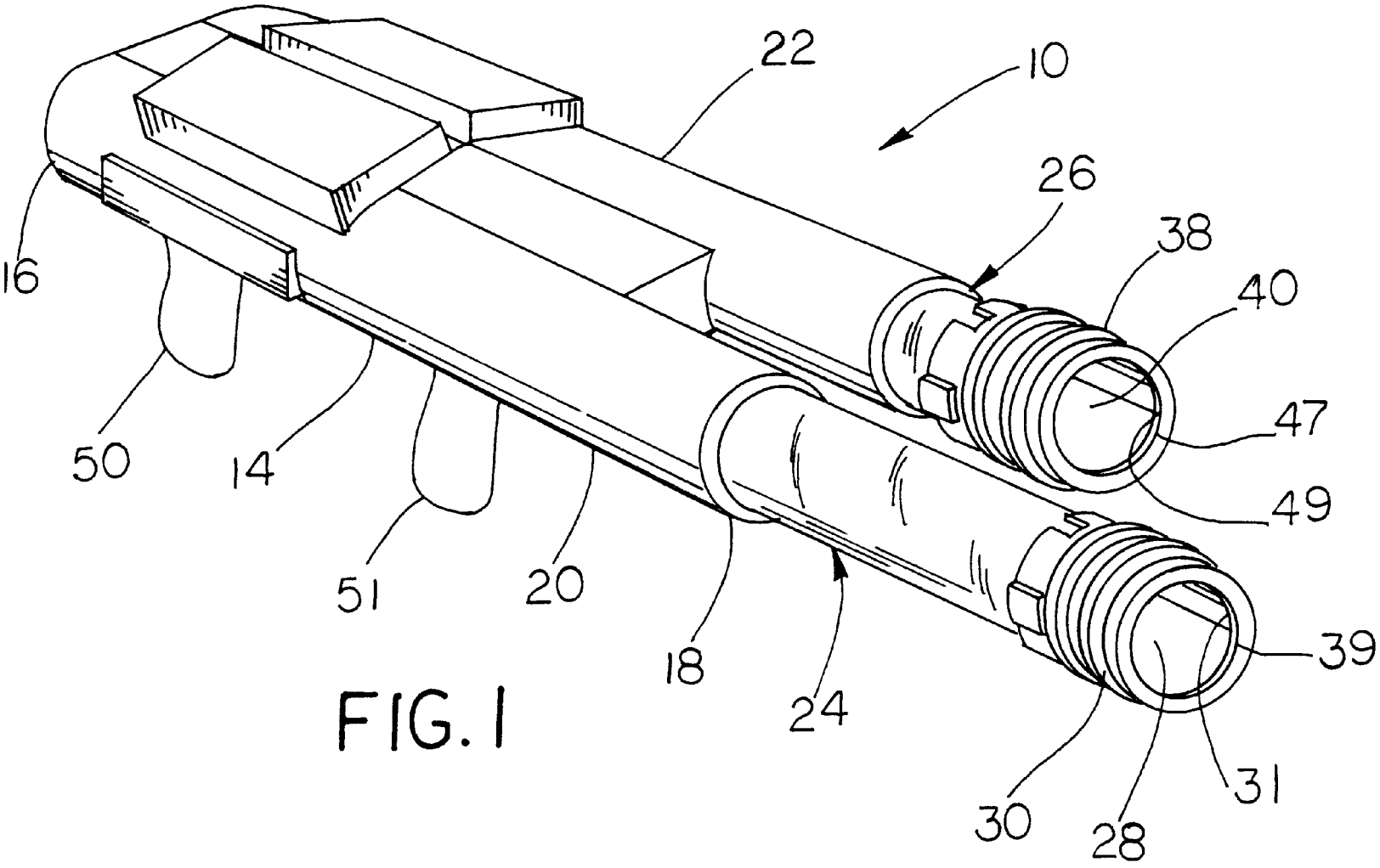
FIG. 1 is a perspective view of a toy gun incorporating the features of the present invention.

The embodiment described herein is not intended to be exhaustive or to limit the scope of the invention to the precise form disclosed. The following embodiment has been chosen and described in order to best explain the principles of the invention and to enable others skilled in the art to follow its teachings.

Referring now to the drawings, a toy gun incorporating the features of the present invention is generally referred to by the reference numeral 10. The toy gun 10 is adapted to launch a plurality of projectiles 12, which are preferably made of a soft foam material, such as expanded vinyl acetate (EVA) foam or expanded polyethylene foam, as is well known in the art. The projectiles 12 are preferably round, although the use of other shapes may be contemplated. The toy gun 10 includes a body 14 having forward and rearward ends 16, 18. The body 14 also includes a pair of right and left barrel housings 20, 22, each of which slidably receives therein a barrel 24, 26, respectively. The barrels 24, 26 are adapted for generally fore and aft movement within their respective barrel housings 20, 22, between a forward position and a rearward position. The barrels 24, 26 are shown mounted to the toy gun 10 in spaced apart, generally parallel side-by-side arrangement. Similar arrangements may be contemplated, such as an over-under arrangement or multiple barrel stacks.

Figure 2:
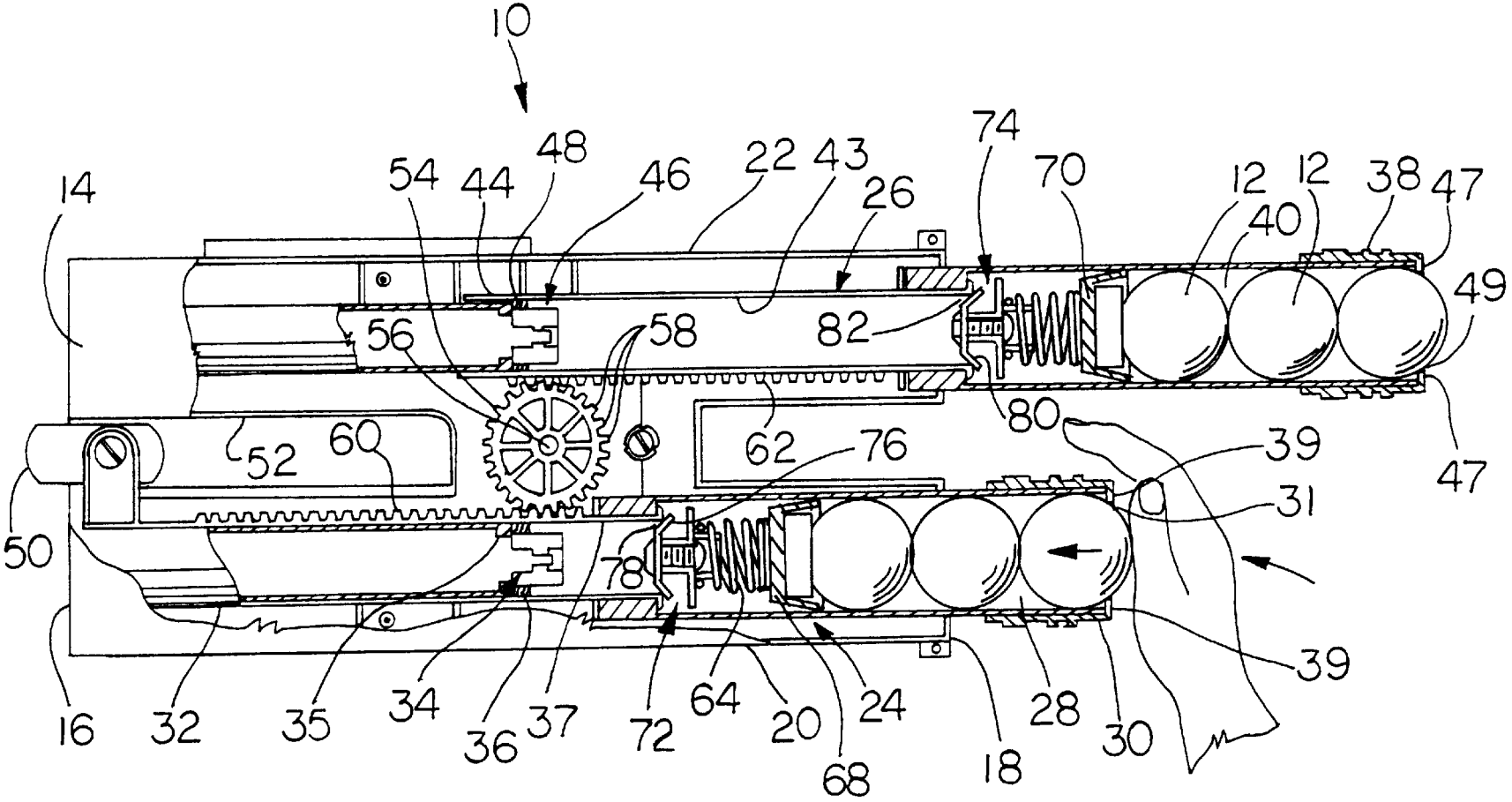
FIG. 2 is a top plan view, partly in section, of the toy gun shown in FIG. 1 and illustrating the foam projectiles being loaded into one of the barrels by a user.

As shown in FIG. 2, the barrel 24 includes a forward end 30 having an opening 31 and a launch chamber 28 sized to receive one or more of the projectiles 12. The barrel 24 also includes a rearward end 32, and a pneumatic launcher or plunger assembly 34. The plunger assembly 34 includes a stationary portion 35 having a seal 36 which registers with an interior surface 37 of the barrel 24 in order to pressurize the launch chamber 28 as will be explained in further detail below. The forward portion 30 of the barrel 24 includes an inwardly extending annular lip 39. The lip 39 slightly constricts the opening 31, such that the projectile 12 must be slightly deformed in order to pass through the opening 31.

Similarly, the barrel 26 includes a forward end 38 having an opening 39 and a launch chamber 40 sized to receive one or more of the projectiles 12. The barrel 26 also includes a rearward end 44, and a pneumatic launcher or plunger assembly 46. The plunger assembly 46 includes a stationary portion 45 having a seal 48 which registers with an interior surface 43 of the barrel 26 in order to pressurize the launch chamber 40 as will be explained in further detail below. The forward end 38 includes an inwardly extending annular lip 47. Again, the projectile must be slightly deformed in order to pass through the opening 39 past the annular lip 47. The plunger assemblies 34 and 46 compress air in the launch chambers 28, 40 using well known pneumatic principles in order to launch the projectiles 12 from the toy gun 10 as will be explained in greater detail below.

Figure 3:
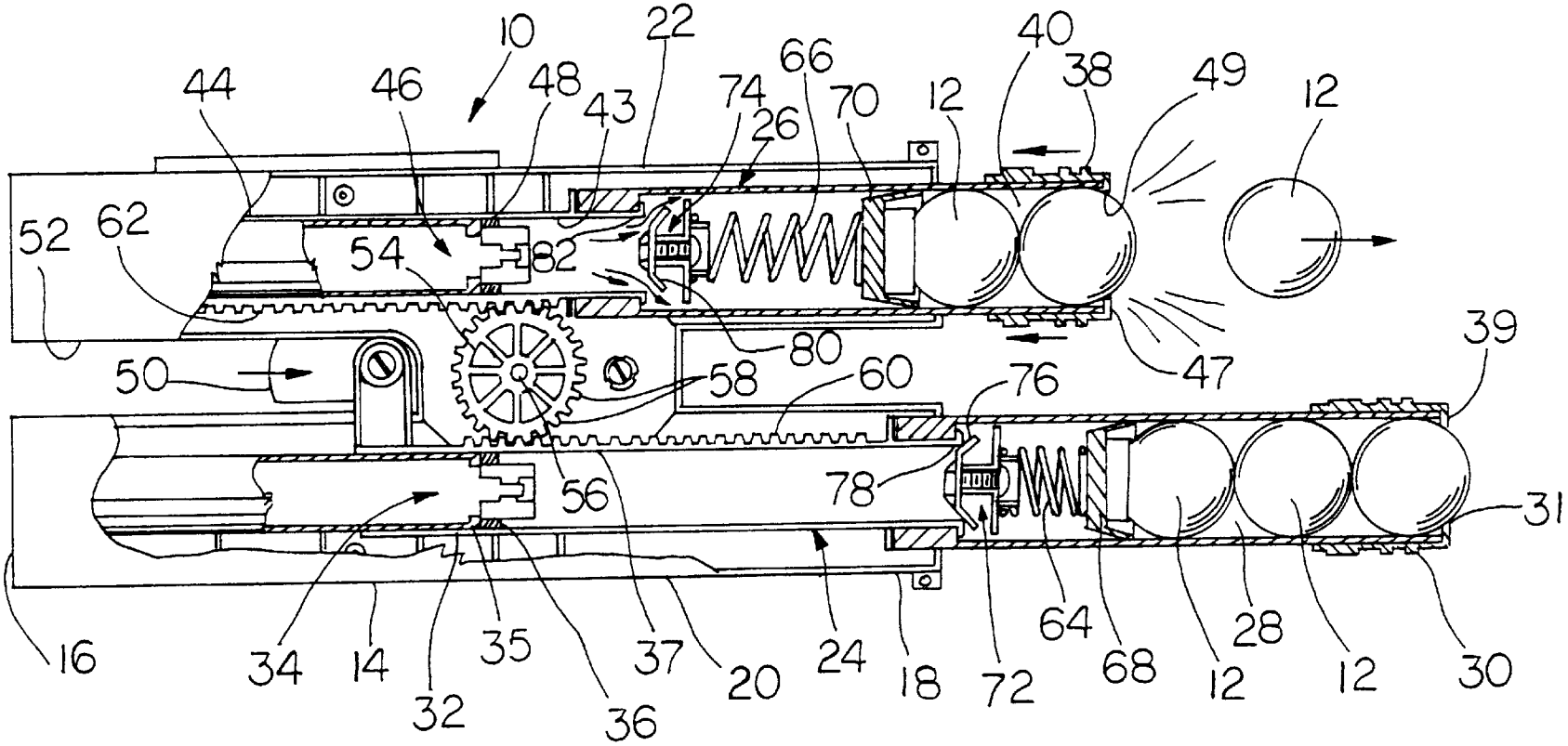
FIG. 3 is a top plan view, partly in section, similar to FIG. 2 but with the barrels having been moved toward their opposite extreme positions and showing a foam projectile being launched from the uppermost barrel.

A moveable handle 50 is mounted to the toy gun 10 generally adjacent the rearward end 18. The moveable handle 50 is attached to the rearward end 32 of the barrel 24, and is moveable along a guide slot 52 defined in the body 14 of the toy gun 10. Alternatively, the moveable handle 50 could be secured to the barrel 26. The moveable handle 50 is shiftable along a generally linear path defined by the guide slot 52 between a rearward position, as shown in FIG. 2, and a forward position, as shown in FIG. 3. The toy gun 10 also preferably includes a stationary handle 51 (visible in FIGS. 5, 6 and 7) secured to the body 14, which facilitates greater control when operating the toy gun 10.

An actuating pinion 54 is mounted to the body 12 by a pivot 56, and is disposed generally between the barrels 24, 26. The actuating pinion includes a plurality of teeth 58, which mesh with toothed racks 60, 62 on each of the barrels 24, 26, respectively. Accordingly, movement of either barrel imparts a corresponding opposite movement to the other barrel. For example, when the handle 50 is disposed in the rearward position of FIG. 2, barrel 24 is likewise in its rearward position by virtue of the connection between the handle 50 and the rearward end 32 of the barrel 24. The barrel 26 is shown in its forward position. When the handle 50 is moved toward its forward position as shown in FIG. 3, the barrel 24 is also moved forwardly, while the barrel 26 moves in the opposite direction toward its rearward position. Repeated movement of the handle 50 back and forth along the guide slot 52 thus causes the barrels 24, 26 to reciprocate back and forth, in opposite directions, between their respective forward and rearward positions.

Each barrel 24, 26 preferably includes an internal spring 64, 66, respectively. Each spring 64, 66 terminates in a seat 68, 70, each of which extends into the launch chamber 28, 40, of its respective barrel 24, 26. The seats 68, 70 abut one of the projectiles 12 in order to bias the outer most projectile 12 contained within the launch chambers 28, 40 against its respective adjacent annular lip 39, 47.

Figure 4:
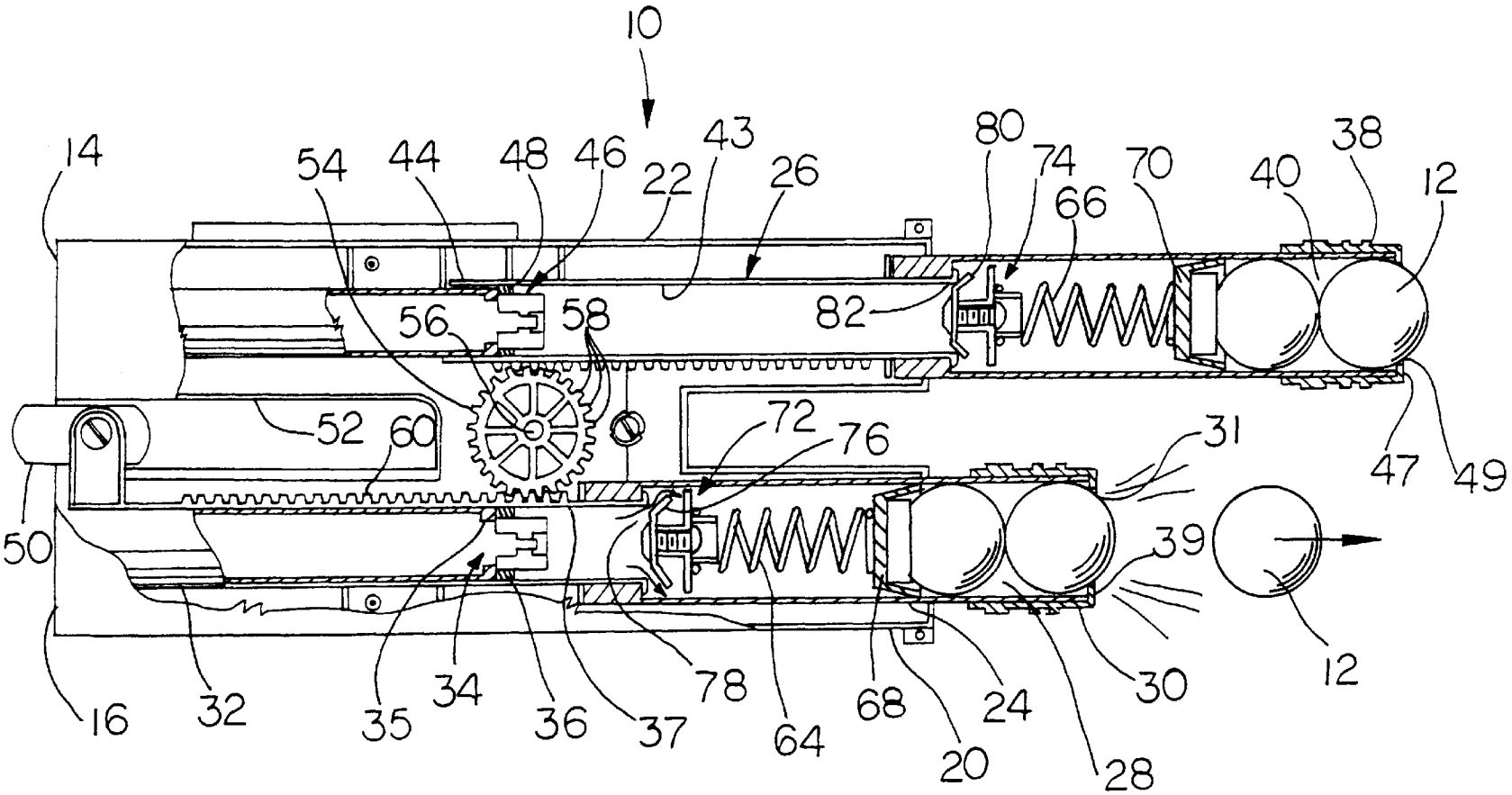
FIG. 4 is a top plan view, partly in section, showing the barrels having been moved again to the position shown in FIG. 2 and showing a foam projectile being launched from the lowermost barrel.

As shown to advantage in FIGS. 2, 3 and 4, each launch chamber 28, 40 includes an inlet valve 72, 74, respectively. As shown in FIG. 2, each inlet valve 72, 74 is normally biased to the closed position shown in FIG. 2 by the springs 64, 66. The inlet valve 72 includes a seal 76 which registers with and seals an entry opening 78 leading to the launch chamber 28 of the barrel 24. Similarly, the inlet valve 74 includes a seal 80 which registers with and seals an entry opening 82 leading to the launch chamber 40. The inlet valves 72, 74 are openable in response to pneumatic pressure created by the plunger assemblies 34, 46, respectively, as the barrels 24, 26 are retracted in order to communicate air pressurized by the plunger assemblies into the launch chambers 28, 40 so as to launch the projectile 12 therefrom as is more fully explained below.

In operation, the toy gun 10 is loaded by inserting one or more projectiles 12 into the launch chambers 28, 40 as is shown in FIG. 3. Loading the projectiles into the launch chambers 28, 40 compresses the spring 64, 66 in the respective launch chamber. Although FIG. 3 shows three projectiles in each launch chamber, it is contemplated that the toy gun or certain components thereof may be made larger or smaller, thus accommodating a different number of projectiles.

Figure 5:
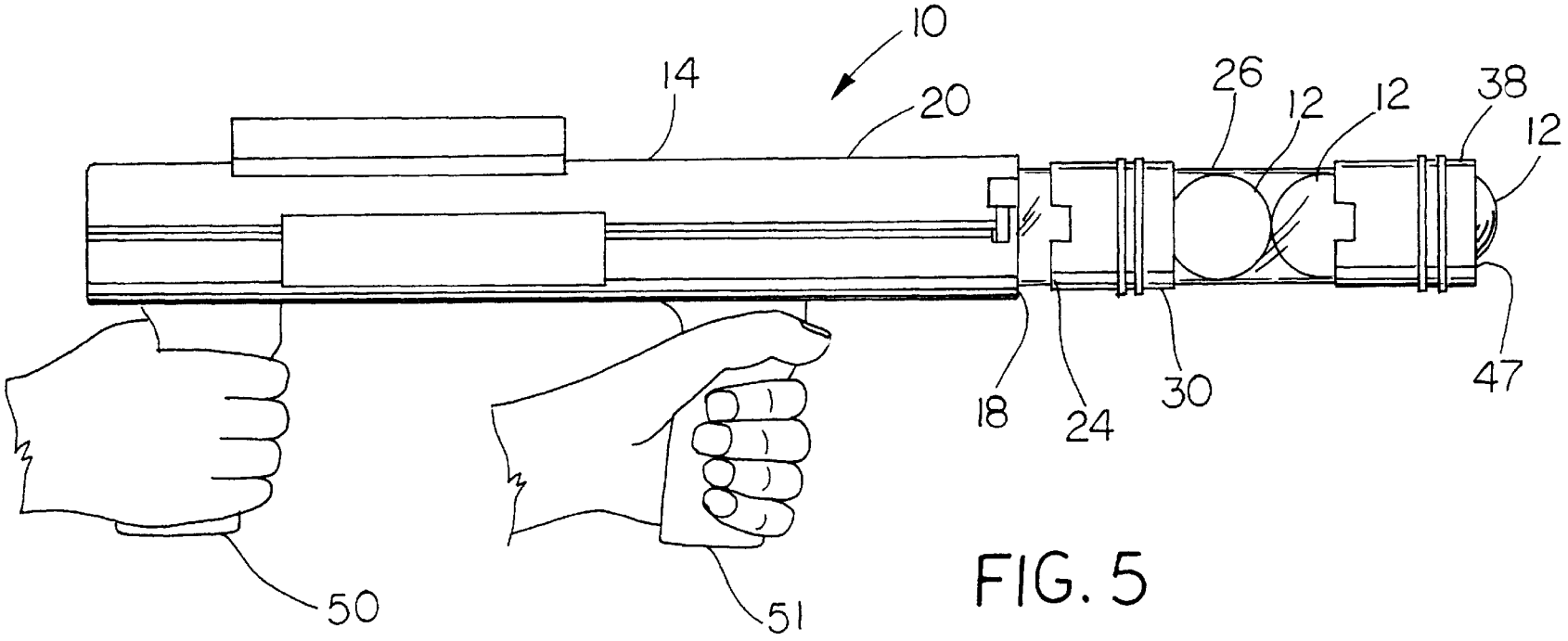
FIG. 5 is a side elevational view, taken along lines 5—5 of FIG. 2 and showing the moveable handle in its rearmost position.
Figure 6:
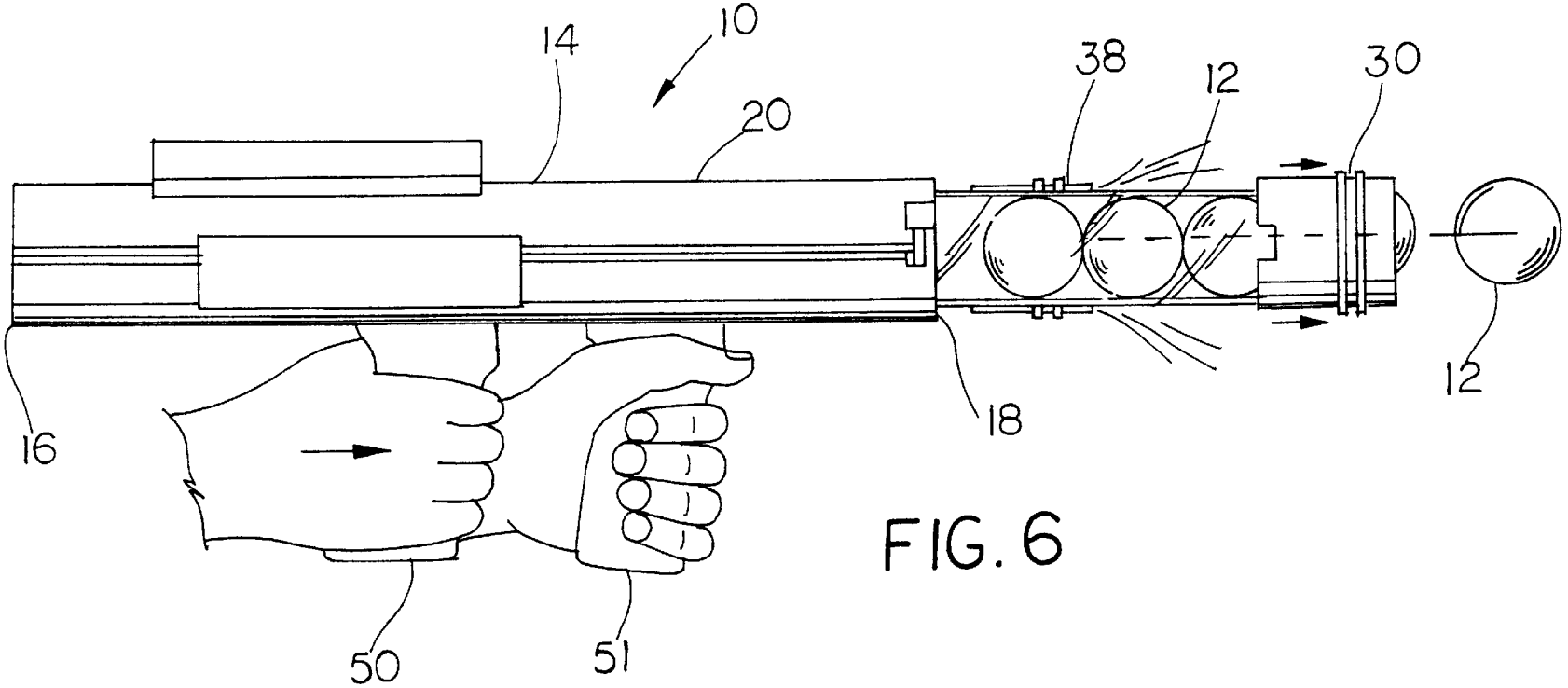
FIG. 6 is a side elevational view, similar to FIG. 5, but showing the moveable handle shifted toward its foremost position which thus reverses the position of the moveable barrels.
Figure 8:
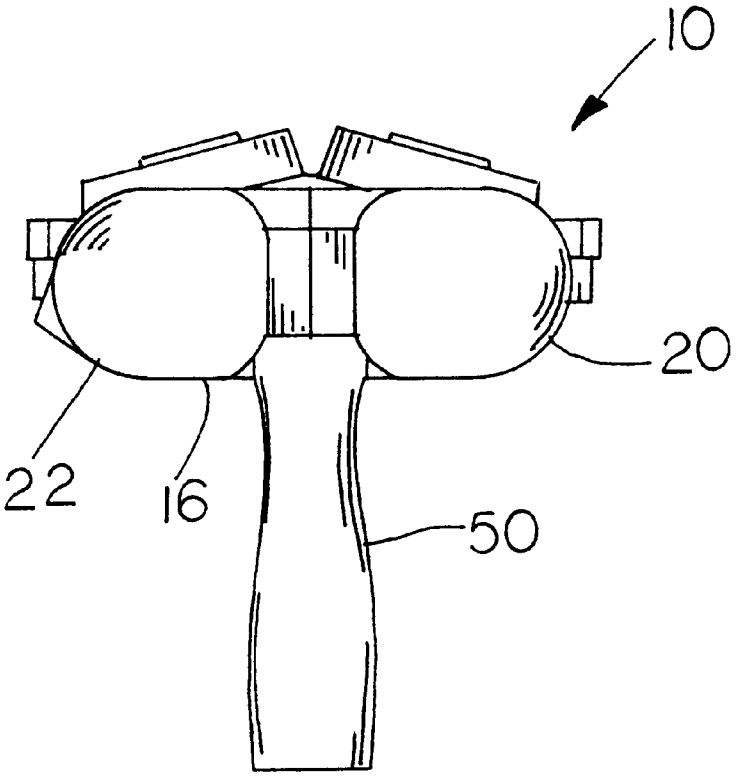
FIG. 8 is a front elevational view thereof.
Figure 7:
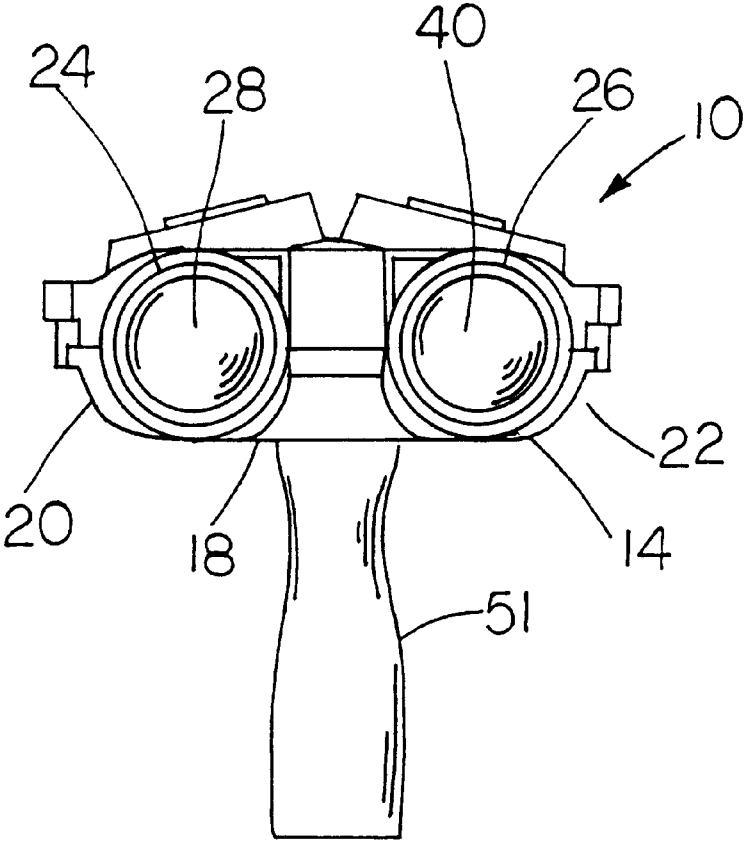
FIG. 7 is a rear elevational view of the present toy gun.

After the toy gun 10 has been thus loaded, the operator grasps the handles 50 and 51 as shown in FIG. 5. In order to prepare the toy gun 10 for use, the operator loads the launch chambers 28, 40 with a plurality of projectiles 12 as is shown in FIG. 2. The inlet valves 72, 74 are both shown in FIG. 2 in their closed positions, biased by their respective springs 64, 66 to seal the entry openings 78, 82, respectively. In order to fire the toy gun 10, the operator moves the handle 50 toward its forward position as shown in FIGS. 3 and 6. In the process, by virtue of the teeth 58 of the actuating pinion 54 meshing with the racks 60, 62, the barrel 24 is moved forwardly, while the barrel 26 is moved rearwardly. As shown in FIG. 3, as the barrel 26 moves rearwardly, the plunger assembly 46 causes the air contained in the barrel 26 to be compressed, such that increasing air pressure within the plunger assembly 46 causes the inlet valve 74 to open, thereby pressurizing the launch chamber 40.

With the forwardmost projectile 12 contained in the launch chamber 40 sealed against the annular lip 47, the air pressure within the launch chamber builds. Eventually, the pressure within the launch chamber 40 reaches a point where the projectile 12, which is deformable by virtue of its foam construction, squeezes through the annular opening 49, thus launching the projectile 12 away from the toy gun 10.

Under certain circumstances, such as when firing the first projectile 12 after loading the toy gun 10, the air pressure within the launch chamber 40 may not be sufficient to launch the projectile 12. Also, in the event a larger projectile is used, the air pressure within the launch chamber 40 may not be sufficient after a single stroke to eject the projectile 12 from the launch chamber. The air inlet valve 74 displaces with each rearward stroke of the barrel 26 to allow additional air to enter the launch chamber 40 through the inlet opening 82. Eventually, the air pressure within the launch chamber 40 builds to a level sufficient to eject the projectile 12 towards the intended target (not shown).

The operator may then launch another projectile 12 from the barrel 24 by pulling back on the handle 50, thus moving the handle to its rearward position as shown in FIGS. 4 and 5. It will be understood that the operation of the air inlet 72 is substantially the same as the operation of the air inlet valve 74 discussed above. Again, the teeth 58 of the actuating pinion 54 mesh with the racks 60, 62. This time, the barrel 24 is moved rearwardly while the barrel 26 is moved forwardly. In the process, as the barrel 24 moves rearwardly, the plunger assembly 34 causes the air contained in the barrel 24 to be compressed, which opens the inlet valve 72 as shown in FIG. 4, thus pressurizing the launch chamber 28. With the forwardmost projectile 12 contained in the launch chamber 28 sealed against the annular lip 39, the air pressure within the launch chamber 28 builds until the deformable projectile 12 squeezes through the annular opening 31, thus launching another projectile 12 away from the toy gun 10. With each fore and aft sequence, a projectile is launched from alternating barrels. Each time a projectile is launched, the springs 64, 66 bring the next projectile into position within the launch chamber 28, 40, seated against the appropriate annular lip 39, 47. The process can be repeated until the supply of projectiles 12 is exhausted.

It will be understood that the above description does not limit the invention to the above-given details. It is contemplated that various modifications and substitutions can be made without departing from the spirit and scope of the following claims.

What is claimed:

1. A toy gun for launching foam projectiles, comprising:

a body;

a pair of barrels slidably mounted to the body and being adapted for movement along a longitudinal path between a rearward position and a forward position, each of the barrels including a longitudinal rack, a plunger assembly, and a forward portion defining a launch chamber adapted to receive a foam projectile;

a moveable handle operatively engaging one of the barrels;

an actuating pinion mounted to the body and engaging each of the barrel racks, the actuating pinion for moving the barrels in opposite directions between their respective forward and rearward positions in response to movement of the handle;

so that each plunger assembly pressurizes its adjacent launch chamber in response to rearward movement of the barrel, thereby permitting a projectile to be launched from the launch chamber of each barrel as that barrel moves toward its respective rearward position.

2. The toy gun of claim 1, wherein each barrel includes an interior surface, and wherein each plunger assembly includes a stationary seal sized to register with the barrel interior surface.

3. The toy gun of claim 1, wherein the launch chamber of each barrel includes a forward end having an inwardly extending annular lip, the annular lip forming a seat sized to receive a foam projectile.

4. The toy gun of claim 3, wherein the projectile is deformable, the annular lip thereby permitting the release of the foam projectile disposed against the seat in response to increasing pressure in the launch chamber.

5. The toy gun of claim 1, wherein each of the barrels is adapted to receive a plurality of foam projectiles, thereby launching the foam projectiles in repeating sequence from alternating barrels in response to repeated forward and rearward movement of the handle.

6. The toy gun of claim 3, wherein each barrel includes an internal spring, the spring for bringing the foam projectile into contact with the seat.

7. The toy gun of claim 1, wherein the handle is moveable along a longitudinal path, the path of the moveable handle being parallel to the path of the barrels.

8. The toy gun of claim 7, wherein the body includes a longitudinal guide passage, the moveable handle extending through the guide passage.

9. The toy gun of claim 1, wherein the barrels are spaced apart and generally parallel to each other.

10. The toy gun of claim 9, wherein the actuating pinion is mounted between the barrels and is pivotable about a vertical axis.

11. The toy gun of claim 1, wherein each barrel launch chamber includes a displaceable inlet valve.

12. A toy gun for launching foam projectiles, comprising:

a body;

a pair of barrels slidably mounted to the body in spaced apart parallel arrangement, each of the barrels being adapted for movement along a longitudinal path between a rearward position and a forward position, each of the barrels including a plunger assembly and a launch chamber adapted to receive a plurality of foam projectiles;

a moveable handle operatively engaging one of the barrels;

an actuator mounted to the body and engaging each of the barrels, the actuator for imparting opposing linear movement to the barrels between their respective forward and rearward positions in response to movement of the handle;

whereby the launch chamber in each barrel is pressurized in response to rearward movement of the barrel, thereby permitting projectiles to be launched from each barrel as each barrel moves toward its respective rearward position.

13. The toy gun of claim 12, wherein the plunger assembly of each barrel includes a stationary seal sized to register with an interior surface of the barrel.

14. The toy gun of claim 12, wherein the launch chamber of each barrel includes a forward end having an inwardly extending annular lip, the annular lip forming a seat sized to receive a foam projectile.

15. The toy gun of claim 14, wherein the projectile is deformable, the annular lip thereby permitting the release of the foam projectile disposed against the seat in response to increasing pressure in the launch chamber.

16. The toy gun of claim 14, wherein each barrel includes an internal spring, the spring for bringing the foam projectile into contact with the seat.

17. The toy gun of claim 12, wherein the handle is moveable along a longitudinal path, the path of the moveable handle being parallel to the path of the barrels.

18. The toy gun of claim 17, wherein the body includes a longitudinal guide passage, the moveable handle extending through the guide passage.

19. The toy gun of claim 12, wherein the barrels are spaced horizontally and the actuating pinion is mounted between the barrels.

20. The toy gun of claim 12, wherein each barrel launch chamber includes an inlet valve.

21. A toy gun for launching foam projectiles, comprising:

a body;

a pair of spaced apart barrels slidably mounted to the body, each of the barrels being moveable along a path between a rearward position and a forward position, each of the barrels including a pneumatic launching mechanism and having a forward portion defining a launch chamber adapted to receive a plurality of foam projectiles, each launch chamber being pressurized in response to rearward movement of its adjacent barrel;

a handle mounted within the body and being moveable along a path;

actuation means responsive to movement of the handle for moving the barrels in opposite directions between their respective forward and rearward positions to thereby launch a repeating sequence of projectiles from alternating barrels as the handle is repeatedly moved along its path.

22. The toy gun of claim 21, wherein the handle is moveable along a linear path.

23. The toy gun of claim 21, wherein the actuation means launches a foam projectile from one of the barrels when the handle is moved toward a first end of the linear path and further launches a foam projectile from the other barrel when the handle is moved toward a second end of the linear path.

24. The toy gun of claim 21, wherein the actuation means includes a longitudinal rack attached to each of the barrels, and further includes a pinion pivotally mounted to the body and engaging each of the racks.

25. The toy gun of claim 21, wherein each barrel launch chamber includes an air inlet valve.

* * * * *